United States Patent [19]

White

[11] 4,322,072

[45] Mar. 30, 1982

[54] EXERCISE WEIGHT UNIT FOR ATTACHMENT TO THE FOOT

[76] Inventor: Gerald A. White, 1427 Morrison St., Madison, Wis. 53703

[21] Appl. No.: 130,439

[22] Filed: Mar. 14, 1980

[51] Int. Cl.[3] ..... A63B 23/04

[52] U.S. Cl. ..... 272/119; 128/166

[58] Field of Search ..... 272/96, 119, 117, 122, 272/123; 405/186, 185; 128/165, 166, 166 S

[56] References Cited

U.S. PATENT DOCUMENTS

| | | | |
|---|---|---|---|
| 2,446,902 | 8/1948 | Brand | 128/166 |
| 3,278,184 | 10/1966 | Rosenbaum | 272/96 |
| 3,306,610 | 2/1967 | Biggs | 272/96 |
| 3,334,898 | 8/1967 | McCrory | 272/96 |
| 3,490,766 | 1/1970 | Gardner | 272/119 |
| 3,699,959 | 10/1972 | Garrahan | 128/166 |
| 3,910,577 | 10/1975 | Boyle | 272/119 |
| 4,192,502 | 3/1980 | Owen | 272/119 |

FOREIGN PATENT DOCUMENTS

| | | | |
|---|---|---|---|
| 720201 | 12/1931 | France | 272/96 |
| 572 | of 1890 | United Kingdom | 272/96 |

*Primary Examiner*—Richard J. Johnson

*Attorney, Agent, or Firm*—Andrus, Sceales, Starke & Sawall

[57] ABSTRACT

An elongated multiple pocketed leg weight unit is attached to the foot of the exerciser for exercising from various sitting and prone positions. The weight unit includes a flexible weight support having a plurality of side-by-side open-ended pockets, each of which is adapted to receive a weight member. A flap member along the open ends is folded thereover onto the adjacent pocket walls to assist holding the weights in place when wrapped over the arch of the foot. The weight unit is attached by a first flexible strap extending longitudinally therefrom around the ankle with the outer end secured as by a Velcro connection to the weight support. A second strap is aligned with the Velcro connection and extends perpendicularly to the first strap, and thus around the bottom of the arch with the outer end secured as by a second Velcro connection to the support.

6 Claims, 5 Drawing Figures

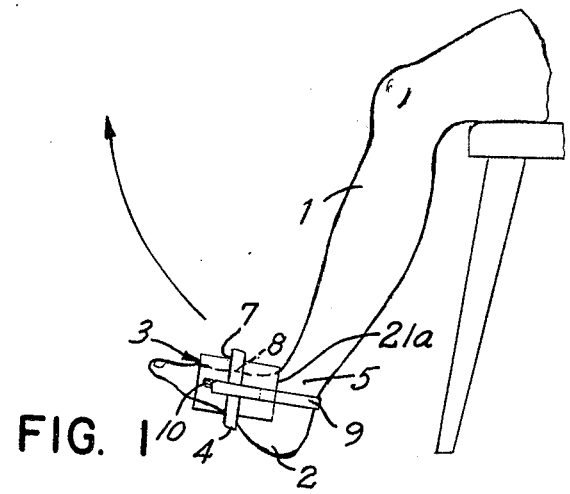
FIG. 1
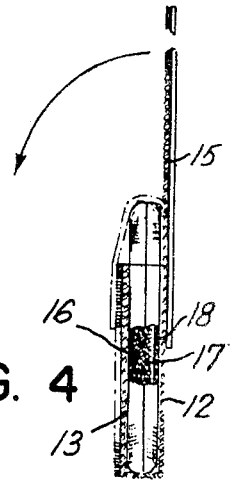
FIG. 4
FIG. 5
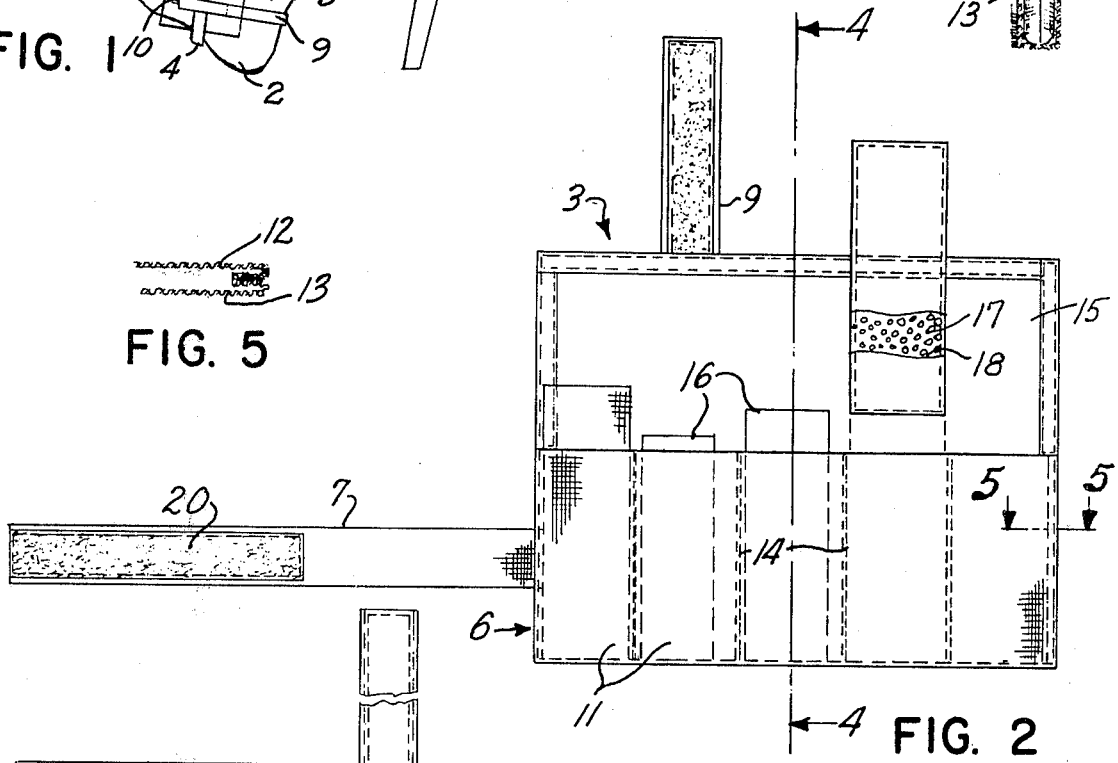
FIG. 2
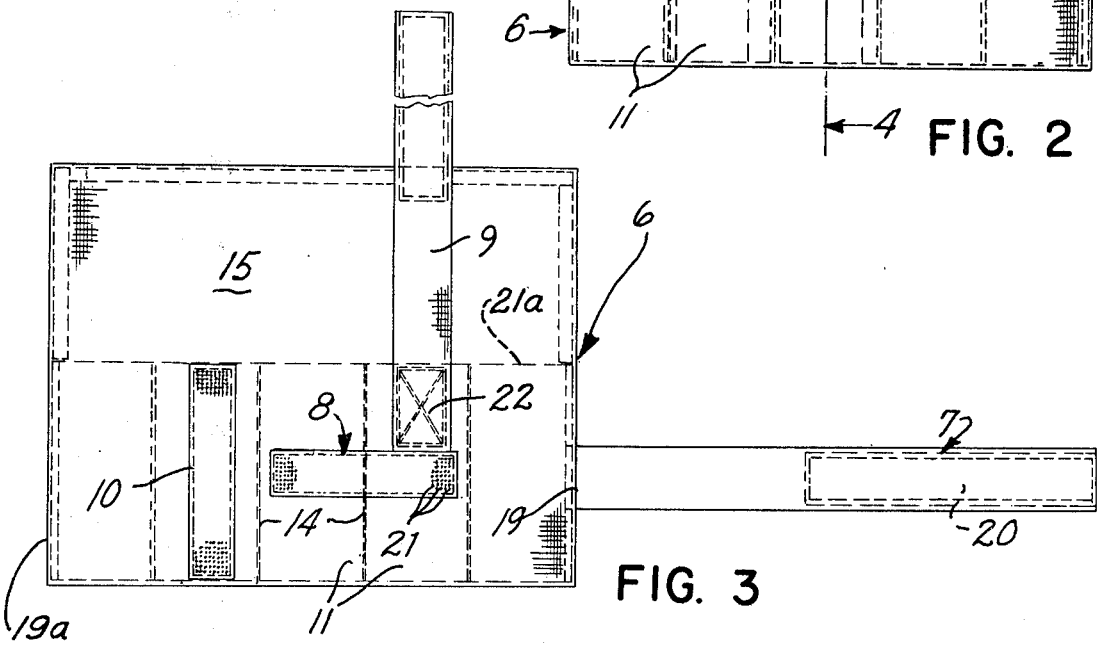
FIG. 3

EXERCISE WEIGHT UNIT FOR ATTACHMENT TO THE FOOT

BACKGROUND OF THE PRESENT INVENTION

The present invention relates to a foot-mounted exercise weight unit and particularly such a unit for attachment to the foot of a person for exercising the leg, hip, knee and the like.

To develop the various muscles of the leg and hip, weights may be applied to the ankle and various leg exercises executed to rebuild or increase the strength of the muscles. Generally, a weight unit is wrapped about the ankle and secured by an encircling tie member, with different level weight unit provided to permit matching the weighting to the present muscle condition. The weight units may be changed during the course of a series of exercises and for different leg exercises. Further, in a sequence of exercises, a series of different body and leg positions are required with a resulting change in the shifting tendency of the weight unit. For example, the leg may be exercised from a sitting position or a prone position, and in the course of the latter, lying on ones back, front or either side. Movement of the leg from the knee and from the hip while in these different positions, of course, positions the weight in various relative positions to the body with gravity tending to move the weight from its attached location and position. Although the weights have generally been applied to the ankle, the weight unit may advantageously be attached to the foot. The weight units tend to shift on the foot and the foot attachment has not therefore been widely accepted. There is a definite need for a more or less universal weight unit having a stable attachment means particularly with provision of a variable weight unit, which can be attached to the foot for all of the various exercises which must be executed, and with individual detachable means.

SUMMARY OF THE PRESENT INVENTION

The present invention is particularly directed to a multiple pocketed weight unit having a pair of releasable attachment means for firmly and positively attaching of the multiple pocketed weight unit to the foot of the exerciser with a stable attachment and position of the unit during various different leg exercises. Generally, in accordance with the teaching of the present invention, an elongated multiple pocketed weight apparatus includes a flexible weight support having a plurality of side-by-side weight open-ended pockets, each of which is adapted to receive a weight member. A flap member is formed along the opening edge of the pocket and is preferably integrally formed therewith. The flap member is folded over the open ends of the pockets onto the adjacent pocket walls to effectively close the pockets and hold the weights in place. The weight support is wrapped over the arch of the foot with the flap abutting the foot. In accordance with the present invention, a pair of perpendicularly interrelated attachment means are secured to the multiple pocketed flexible weight supports. The attachment means includes a first flexible elongated tie member secured to the pocketed support and projecting longitudinally outwardly therefrom as a flexible tie. The outer end of the flexible tie member is provided with a releasable latch element adapted to be secured to a second releasable latch element which is secured to the weight support. The second latch element is generally aligned with the first flexible tie member and secured to the support proximate the first tie member. A second flexible tie member is secured to the multiple pocketed weight support adjacent to the first tie receiving member and projects outwardly perpendicularly to the first tie member. The second tie member extends over and beyond the flap member with the outer end provided with extended connection or attachment portion. A second flexible tie connector is secured to the weight support spaced from the first tie receiving member and also extending perpendicular thereto. The tie members and connectors are preferably formed with a Velcro-type releasable connection which provide a releasable connection while permitting the necessary adjustment in the length of the tie member.

The perpendicularly related tie members in combination with the multiple pocketed support and flap provide an efficient means for securing of the weight wrapped around the arch of a foot. The first tie member securely attachs the weight support wrapped about the arch of a foot and the second tie member firmly secures the wrapped unit to the ankle portion to positively and firmly hold the exercise weight unit to the foot regardless of the exercise, the body position and the movement of the leg and foot.

The present invention particularly provides a versatile adjustable exercise weight unit. Although one size may cover a wide range of size and weight requirements, the unit can be made in various basic sizes for accommodating significantly different weights and disabilities.

DESCRIPTION OF THE ILLUSTRATED DRAWING FIGURES

The drawing furnished herewith illustrates a preferred construction of the present invention in which the above advantages and features are clearly disclosed as well as others which will be readily understood from the following description.

In the drawing:

FIG. 1 is a pictorial view of a leg having an exercise weight unit, constructed in accordance with one embodiment of the present invention, attached thereto;

FIG. 2 is a plan view of the weight unit shown in FIG. 1 and illustrating the pocketed construction for varying the total weight of the unit;

FIG. 3 is a back view of the weight unit shown in FIGS. 1 and 2, and more clearly illustrating the attachment means;

FIG. 4 is a vertical section taken generally on line 4—4 of FIG. 2; and FIG. 5 is a view taken generally on line 5—5 of FIG. 2.

DESCRIPTION OF THE ILLUSTRATED EMBODIMENT

Referring to the drawing and particularly to FIG. 1, a leg 1 and foot 2 of a person positioned on a chair or similar support is diagrammatically illustrated. A weight unit 3 constructed in accordance with the present invention is detachably secured to the foot 2 and particularly around the arch portion 4 of the foot to permit the movement of the foot from the illustrated as well as all other leg and hip exercise position. Thus, in addition to sitting position in which raising the foot tends to cause the weight unit 3 to move down over the foot toward the ankle portion 5, the person may be lying or kneeling on the floor or other support with the foot moving in the opposite direction and with the weight unit gravity biased to move toward the toes and off the end of the foot. Other positions and exercise movements may tend to cause sideways movement of the weight on the foot 2.

The weight unit 3 is specially constructed with a releasable attachement means, such that it is firmly attached to the foot and will not move from such position to permit all such exercise movements. For example, if the person is lying on the stomach and is doing ham string or knee flexion exercise, the knee should not rotate. If the weight moves, the movement will tend to also rotate the knee with possible damage. The present invention securely locks the weight in place so as to practically avoid such weight movement. Generally in accordance with the present invention, the illustrated weight unit 3 includes a multiple pocketed weight support 5 which is adapted to be wrapped about the arch portion 4. A first elongated flexible tie member 7 is secured to the support 6 and extends longitudinally from the weight support. The free end of the tie member 7 releasably attaches to a first fixed tie connector 8. A second elongated flexible tie member 9 is also secured to the support unit 3 and extends outwardly therefrom perpendicular and proximate to the first receiving connector member 8. A second fixed connector 10 is secured to the pocketed weight support longitudinally spaced from the first connector 8 and is adapted to receive the free end of the second flexible tie member element 9. The first tie member 7 wraps about the wrapped support 3 for fixedly and firmly attaching of the multiple pocketed support 6 about the arch portion 4 of the foot. The second tie member 9 extends outwardly from the pocketed weight support 6 around the back of the foot and ankle portion 5 and back to the second connector 10 and locks the weight with the inner edge abutting the ankle portion, as shown in FIG. 1. This results in a very firm and positive attachment of the weight unit 3 to the foot and has been found to hold the weight unit in a stable position during all exercise movement.

Referring to FIGS. 2–5, a preferred embodiment of the invention as shown in FIG. 1 is more clearly illustrated. Referring particularly to FIGS. 2 and 3, the multiple pocketed support 6 is a generally rectangular flexible member having a plurality or series of individual receiving pockets 11 located in side by side relation. The support 6 may be formed of a backwall 12 and a front wall 13 of a suitable canvas-like fabric or the like which is folded over and interconnected along the edges by conventional sewing. The plurality of pockets 11 are formed by stitching parallel closures 14, with the pockets 11 open at the outer edge. The back wall 12 includes a flap 15 which extends outwardly from the pocket openings, and which is preferably formed integral with the back wall 12.

The pockets 11 are adapted to receive the individual weight 16 members which are separately formed with different individual weight levels, such that one or more may be provided in different combinations to produce the necessary or desired weight for appropriate exercising of the muscles. The weight members 16 are preferably constructed with a certain degree of flexibility to permit contouring of the weight unit and conforming to the foot. Each weight member is shown including a particulate material 17 such as lead shot contained within a suitable outer fabric cover 18. In use, the flap 15 is folded down over the open ends of the pockets 11 and particularly the weights 16 to firmly hold the weights in place, as more fully discussed hereinafter.

The location and construction of the tie means are most clearly shown in FIG. 3. The first tie member 7 is an elongated flexible strap sewn into the first side edge edge of the support 6, as at 19, adjacent the end pocket 11. The tie strap 7 is located generally centrally on the length of the adjacent end pocket 11 and extends outwardly parallel to the rectangular support. The outer end of the strap 7 includes an elongated attachement element 20 such as used in Velcro-type attachment units. Thus, element 20 may, for example, be a Velcro-type fabric which is sewn or otherwise firmly affixed to the flexible strap 7. The cooperating connector 8 is shown as a flexible Velcro-type strip having a plurality of plastic hook-like members 21, which strip is also sewn to the back wall of the support 6. The connector 8 is shown located in alignment with the tie member 7 and spaced inwardly from the tie member. Thus, connector 8 is located generally centrally of the support 6 between the first side edge 19 and the second side edge **19*a*. When the weight unit is wrapped over the foot, member 20 is pressed onto the Velcro-type member 8 and particularly the hook members 21** to create releasable attachment.

The second tie member 9 and connector 10 are similarly Velcro-type elements which are similarly firmly affixed to the backwall of the weight support. Tie member 9 is thus a strap which has the one end sewn to the backwall 12 as at 22. The member 9 is located adjacent the outer ends of pockets 11 and aligned with the edge end of the connector 8. The second connector 10 is an elongated Velcro-type unit secured to the backwall 12 in laterally spaced relation to the connector 8 and tie member 9. The connector 10 extends parallel to the second flexible tie strap 9 and substantially for the length of pockets 11.

In use, the appropriate size and number of weights 16 are located in the pockets 11 to provide the total desired weight. The flap 15 is folded along a line or longitudinal end edge **21*a* over the open end of the pockets 11 and projecting weight members 16. The weight unit 3 and particularly support 6 is then preferably centered over the top of the arch 4 and wrapped about the arch 4 of the foot 2 with the flap 15 and longitudinal end edge immediately adjacent and engaging the connection of the foot and the ankle. The weights 16 are thus preferably centered on the top of the arch portion and wrapped about each side of the foot 2. The tie member 7 is then wrapped about the foot 2 and the tie member 9 is wrapped about the foot and ankle 5 as shown in FIG. 1, with the ends pressed onto the respective connectors 8 and 10** to firmly and positively affix the weight unit to the foot in such a manner that it will be retained regardless of the movement and position of the foot during the exercises. The weights can be conveniently and rapidly changed if desired.

Although considered generally significantly inferior, the unit could be firmly affixed about the ankle, to replace the conventional ankle weight. Thus, the tie member 7 secures the support wrapped about the ankle while the second tie member 9 extends beneath the foot to lock the annular weight unit to the foot.

In a particularly practical construction which has provided a universal weight unit, the pocket support and flap was formed as a canvas member $18\frac{1}{2}$ by $21\frac{1}{2}$ inches. Five pockets were provided and each had a depth of approximately 11 inches. The tie member 7 was an 18 inch strap with a 9½ inch "Velcro" member. The tie member 9 was a 17 inch strap with a 8 inch "Velcro" member. The connectors 8 and 10 were each 6½ inch "Velcro" members. This unit provides a wide range of weights which can in single unit be constructed to cover a known range requirement of from 0 to 30 pounds. The unit also prevents slipping or sliding of the weight unit from the fixed position and thereby minimizes a potentially undesirable condition during the use of the unit.

The invention has thus been found to provide a simple, reliable and positive exercise weight apparatus providing varying weights for releasable attachment to the foot during the various leg and hip exercises.

Various modes in carrying out the invention are contemplated as being within the scope of the following claims, particularly pointing out and distinctly claiming the subject matter which is regarded as the invention.

I claim:

1. A variable weight exercise unit for releasable attachment over the arch portion of a human foot, comprising an elongated pocketed support means of a substantially rectangular shape and of length to provide convenient wrapping of the support means over the arch portion of a foot, said support means having a series of individual open-ended weight pockets between first and second side edges and extending from a longitudinal end edge to an open pocket end, individual weights removably located within said pockets, first attachment means including a flexible tie member extending from a first side edge of the elongated support means and having an outer free end adapted to extend around a foot and be releasably connected to the support means to hold the support means in said wrapped position, a second flexible tie member secured to said support means adjacent said first side edge and extending outwardly of said pockets generally perpendicular to said first tie member and having an outer free end adapted to extend around an ankle and be releasably connected to the support means adjacent said second side edge for attaching the support means in said wrapped position over the arch portion of the foot with a longitudinal end edge abutting the connection of the foot and ankle.

2. The exercise unit of claim 1 having a flexible flap secured to said support and extending outwardly of said open ends of said pockets and foldable back over said open ends for holding said weights within said pockets.

3. The exercise unit of claim 1 wherein said pockets are formed as a series of similar width and aligned rectangular pockets of the same length, a flap secured to the support means and extended outwardly of said open ends and folded over said open ends and said weights and conjointly with said tie members closing said pockets and holding said weights in place.

4. The exercise unit of claim 3 wherein said support means includes a flexible sheet-like front and back walls integrally connected at one edge to form the bottom of said pockets, and said front and back walls being connected along said side edges and in a plurality of spaced parallel seams to define said pockets, and said flap member being attached to said back wall and extending outwardly of said open ends of said pockets and folded over said open ends to secure said weights within said pockets.

5. The exercise unit of claim 4 wherein said first tie member is a strap having one end fixedly secured to said first side edge of said support and having an elongated releasable connection element on the outer end portion of said strap, a second elongated releasable connection element secured to said back wall adjacent said first side edge and in alignment with said strap for receiving said elongated releasable connection element and conjointly defining a variable length connection means, said second tie member is a strap secured to said back wall adjacent said second elongated releasable connection element and extending outwardly perpendicular to said connection element and having a third elongated releasable connection element on the outer end portion, and a fourth elongated releasable connection element secured to said back wall between said second connection element and said second edge and extending parallel to said pockets for receiving the connection element of the second tie member and conjointly defining a variable length connection means.

6. The exercise unit of claim 5 wherein each of said paired connection elements include a tufted fabric-like element and a multiple hook element defining a hand pressed releasable connection.

* * * * *

UNITED STATES PATENT AND TRADEMARK OFFICE

CERTIFICATE OF CORRECTION

PATENT NO. : 4,322,072

DATED : March 30, 1982

INVENTOR(S) : Gerald A. White

It is certified that error appears in the above-identified patent and that said Letters Patent are hereby corrected as shown below:

| | | |
|---|---|---|
| Column 3, | Line 19, | After "support" cancel "5" and substitute therefore --- 6 ---; |
| Column 3, | Line 28, | After "support" insert --- adjacent the second side edge 19a ---; |
| Column 4, | Line 46, | After "edge" insert --- 21a ---. |

Signed and Sealed this

*Fifteenth* Day of *February 1983*

[SEAL]

*Attest:*

GERALD J. MOSSINGHOFF

*Attesting Officer*

*Commissioner of Patents and Trademarks*